United States Patent [19]

Ferrante et al.

[11] 4,145,778

[45] Mar. 27, 1979

[54] DOUBLE FITTED SHEET AND METHOD OF MAKING

[76] Inventors: Michele Ferrante; Franca G. De Ferrante, both of Calle Caicara 35-05, Caracas, Venezuela

[21] Appl. No.: 821,973

[22] Filed: Aug. 4, 1977

[51] Int. Cl.[2] ..... A47G 9/00

[52] U.S. Cl. ..... 5/334 R; 5/335; 5/343

[58] Field of Search ..... 5/334 R, 335 C, 343; 112/400

[56] References Cited

U.S. PATENT DOCUMENTS

| | | | |
|---|---|---|---|
| 3,879,777 | 4/1975 | Walker | 5/334 C |
| 3,900,909 | 8/1975 | Monier et al. | 5/334 C |
| 3,962,739 | 6/1976 | Crockett | 5/334 C |
| 4,045,831 | 9/1977 | Clark | 5/334 C |

*Primary Examiner*—Casmir A. Nunberg

*Attorney, Agent, or Firm*—Fisher, Christen & Sabol

[57] ABSTRACT

A double fitted sheet is disclosed in which a lower fitted sheet is formed to fit over the entire upper area of a mattress. An upper sheet, also formed to fit around the foot end of the mattress, is attached to the lower fitted sheet around the sides and foot portion. The head portion of the upper sheet is folded downwardly to facilitate ingress and egress between the upper and lower sheets.

2 Claims, 5 Drawing Figures

DOUBLE FITTED SHEET AND METHOD OF MAKING

FIELD OF THE INVENTION

This invention relates to bed coverings, more particularly such coverings having upper and lower fitted sheets.

BRIEF DESCRIPTION OF THE PRIOR ART

Fitted sheets, per se, are well known and are generally formed with their sides and ends sewn together to fit over the sides and ends of the mattress.

The upper covering, whether it be a sheet or blanket is attached to the bed in the normal manner i.e. by tucking the sides and foot end under the mattress. This has been found to be grossly inconvenient, since the tossing and turning of the sleeper will invariably pull the upper covering out of its tucked in position.

In the case of small children, this drawback is more than inconvenient. If such a covering is used on a crib, for instance, the restless sleeping of the child raises the danger of suffocation should the upper covering come loose. At the very least, the loose covering may expose the child to the inconvenience of a cold or other minor illnesses.

SUMMARY OF THE INVENTION

The present invention relates to a double fitted sheet wherein the upper covering sheet is attached to the lower fitted sheet so as to avoid the aforementioned deficiencies of the prior art coverings. The upper sheet is attached to the lower sheet at both sides and across the foot portion.

The double fitted sheet according to the invention is made from a generally rectangular pattern for the lower fitted sheet and a generally trapezoided pattern for the upper fitted sheet. Triangular, diagonal cuts are made in each of the corners of the lower sheet pattern to remove a portion of the material in each corner. The ends and sides are then sewn together to form the fitted lower sheet.

Similar pieces of material are removed from the corners at the smaller base of the trapezoidal pattern. The end is then sewn to the sides to form the foot portion of the fitted upper sheet. The longer base of the trapezoid is folded over to facilitate ingress and egress after the upper sheet is attached to the lower sheet.

The upper fitted sheet is attached to the lower fitted sheet by sewing the lower edges of each together beginning at the end of the aforementioned fold on the upper fitted sheet. The sheets are sewn together down both sides and across the width at the foot end. Joining the sheets together may also include elastic or other stretchable material to insure the retention of the sheets in position on the mattress.

DETAILED DESCRIPTION OF THE PREFERRED EMBODIMENT

Figure 1:
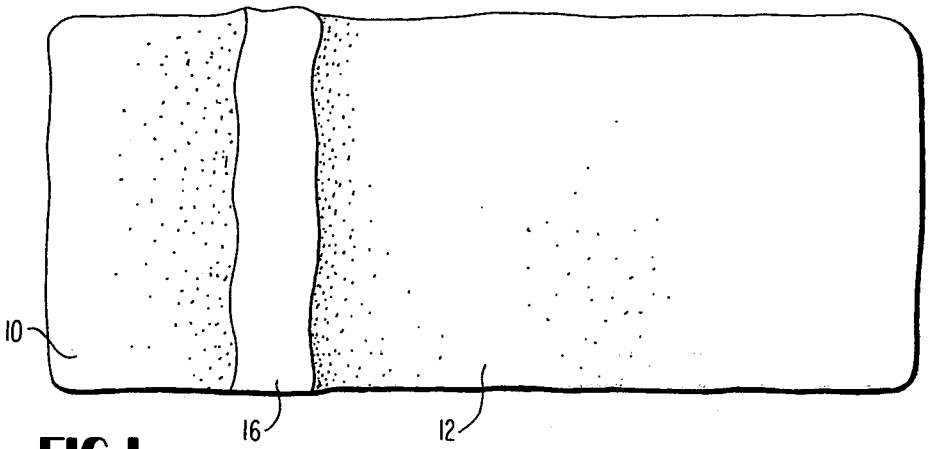
FIG. 1 is a top view of the double fitted sheet according to the invention.
Figure 2:
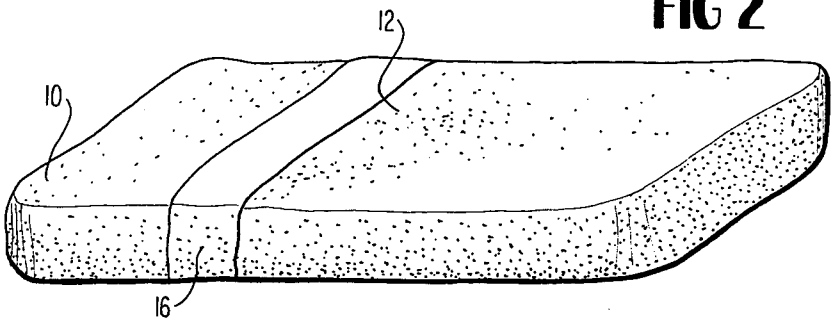
FIG. 2 is a perspective view of the double fitted sheet of FIG. 1.
Figure 3:
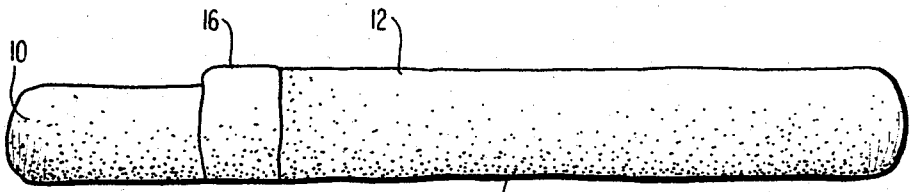
FIG. 3 is a side view of the double fitted sheet of FIG. 1.

The double fitted sheet according to the invention is shown in FIGS. 1–3 and comprises lower fitted sheet 10 and upper fitted sheet 12. Lower fitted sheet 10 has all four corners configured to fit over the four corners of mattress 14. Upper fitted sheet 12 has the two corners located at the foot of the mattress configured so as to fit thereover. The opposite end of upper sheet 12 is folded over as at 16 to permit easy ingress and egress.

Figure 4:
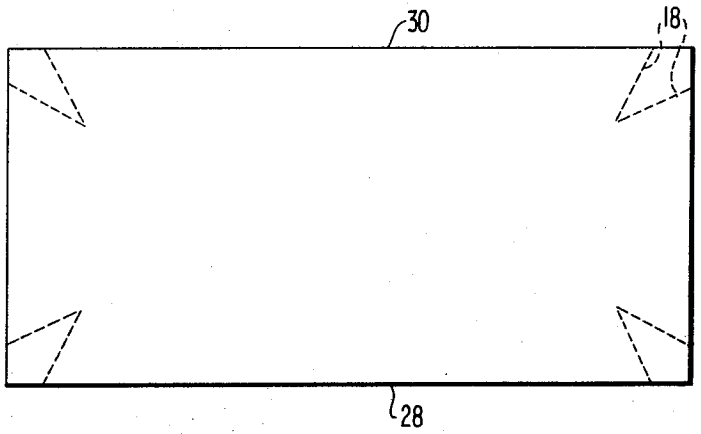
FIG. 4 is a top view of the pattern for forming the lower sheet of the double fitted sheet of FIG. 1.
Figure 5:
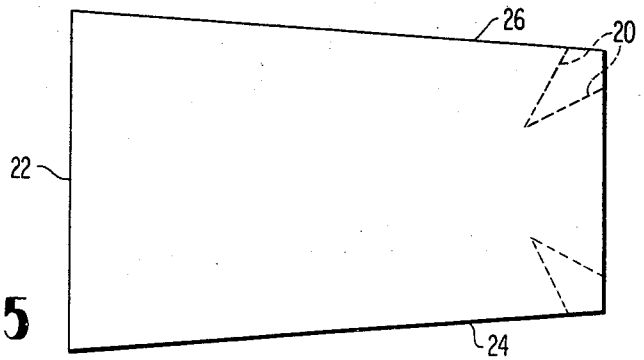
FIG. 5 is a top view of the pattern for forming the upper sheet of the double fitted sheet of FIG. 1.

The patterns for the lower and upper fitted sheets are shown in FIGS. 4 and 5. The pattern for the lower fitted sheet is generally rectangular and, for use on a baby crib or the like, may be 1.76 meters long and 1.19 meters wide. Two generally diagonal cuts 18 are made at each of the four corners of the lower sheet pattern and the material between the cuts is removed. The sides of the triangular shaped openings are sewn together in an internal vertical seam so that the lower sheet takes the shape of the mattress at the four corners.

Similar triangular openings are formed by cuts 20 in the foot end of upper fitted sheet pattern. An internal vertical seam is formed by sewing the sides of the openings together so that the foot end of the upper sheet fits over the foot end of the mattress. The pattern for the upper fitted sheet may be 1.56 meters long, 1.19 meters wide at the foot end and 1.38 meters wide at the head end. The head end 22 is folded over toward the foot end until a turn of approximately 24 centimeters is formed.

The thusly formed upper fitted sheet is placed over the lower fitted sheet such that the foot end is over the foot end of said lower sheet. Sides 24 and 26 of the upper fitted sheet are sewn to sides 28 and 30 of the lower fitted sheet by beginning at the ending of the folded portion of the upper fitted sheet and proceeding toward the foot end. The coinciding foot portions and the corners between the sides and foot are also sewn together.

An elastic ribbon, or other stretchable material, may be applied to the juncture of the upper and lower fitted sheets to retain them in the proper position on the mattress.

The double fitted sheets are now ready for installation on a mattress. The extra width of the head end of the upper fitted sheet pattern allows the upper sheet to be pulled slightly upward to facilitate ingress and egress after the double fitted sheet has been placed on the mattress.

We claim:

1. A double fitted sheet comprising:

(a) a lower fitted sheet having head and foot end portions to fit over the head and foot ends of a mattress; and, (b) an upper fitted sheet formed from a trapezoidal shaped blank wherein a head end portion is of greater width than a foot end portion, said foot end portion being configured to fit over said foot end of said mattress and said foot end portion of said lower fitted sheet, wherein said upper fitted sheet is sewn to said lower fitted sheet across said foot end portion and along substantially the entire length of both sides of said upper fitted sheet.

2. The double fitted sheet of claim 1 further comprising elastic means attached to at least the end portions of said lower fitted sheet to retain the double fitted sheet in position on said mattress.

* * * * *